US009261280B2

(12) United States Patent
Santinato et al.

(10) Patent No.: US 9,261,280 B2
(45) Date of Patent: Feb. 16, 2016

(54) USER INTERFACE AND COOKING OVEN PROVIDED WITH SUCH USER INTERFACE

(75) Inventors: Matteo Santinato, Albignasego (IT); Ettore Arione, Leggiuno (IT)

(73) Assignee: Whirlpool Corporation, Benton Harbor, MI (US)

( * ) Notice: Subject to any disclaimer, the term of this patent is extended or adjusted under 35 U.S.C. 154(b) by 2245 days.

(21) Appl. No.: 12/114,868

(22) Filed: May 5, 2008

(65) Prior Publication Data

US 2008/0276203 A1 Nov. 6, 2008

(30) Foreign Application Priority Data

May 4, 2007 (EP) ..... 07107480

(51) Int. Cl.
*G06F 3/00* (2006.01)
*F24C 7/08* (2006.01)

(52) U.S. Cl.
CPC ..... *F24C 7/086* (2013.01); *F24C 7/085* (2013.01)

(58) Field of Classification Search
CPC ..... G06F 3/0421; G06F 2203/04808; G06F 3/147; G06F 3/0488
USPC ..... 715/751
See application file for complete search history.

(56) References Cited

U.S. PATENT DOCUMENTS

2004/0216471 A1* 11/2004 Kim et al. ..... 62/126
2005/0110768 A1* 5/2005 Marriott ..... G06F 3/03547 345/173
2006/0259547 A1* 11/2006 Bogatin et al. ..... 709/203
2007/0158335 A1* 7/2007 Mansbery ..... H05B 6/6435 219/505
2007/0190259 A1* 8/2007 Bittner et al. ..... 427/407.1

* cited by examiner

*Primary Examiner* — Amy Ng
*Assistant Examiner* — Andres E Gutierrez

(57) ABSTRACT

An user interface for domestic appliances, particularly for cooking ovens, comprises input and display for showing menus and/or items selected by the user through said input. The input comprises a selection zone where the user's finger can move, the display having at least a portion with a shape substantially corresponding to the shape of the selection zone and showing the result of the finger movement in terms of item or menu selection.

11 Claims, 3 Drawing Sheets

USER INTERFACE AND COOKING OVEN PROVIDED WITH SUCH USER INTERFACE

BACKGROUND OF THE INVENTION

1. Field of the Invention

The present invention relates to a user interface for domestic appliances, particularly for cooking ovens, comprising input and display for showing menus and items selected by the user through the input.

2. Description of the Related Art

It is well known in the art of domestic appliances to use electronic user interfaces with buttons or with a touch control panel in order to set functions and/or parameters according to the user's choice. There exist many styles of input devices for consumer products; in domestic appliances are mainly used knobs and switches, buttons and touch screens. Each technology has advantage and disadvantages that are taken in consideration in designing a new appliance. By pressing a button or by touching a zone of the touch control panel the user can set his choices.

The use of a touch sensitive display in domestic appliances, particularly in cooking appliances, presents the disadvantage of easily soiling the display if this latter is touched with not perfectly clean fingers. This can cause problems in reading correctly the various parameters and/or functions to be chosen by the user. In view of the several choices of parameters/functions of a modern appliance, it is often necessary to use big displays that have a negative impact on the overall cost of the appliance.

SUMMARY OF THE INVENTION

One aspect of the present invention is to provide a user interface which does not have the above mentioned problems and which is economical to produce and install on a domestic appliance.

This aspect is achieved thanks to the features listed in the appended claims.

Another aspect of a user interface according to the present invention relates to its improved cleanability. The user interface according to the present invention may work independently on the appliance door configuration (open or closed), self-updating sensitivity to compensate also the humidity and high temperature. The new user interface establishes a direct feedback from the action of the customer finger and the selected item on the menu displayed to improve usability.

One of main items of the present invention is to improve the cleanability by developing a new user interface that permits also full flat implementation thereof. The user interface according to the present invention improves also the usability thereof since the movement of input pointer, i.e. the user's finger, corresponds to the relative movements of the selector in the graphical user interface.

Just few touch buttons are required to activate the user selection or move back to a previous menu or simply to switch ON/OFF the entire appliance.

The graphical user interface is also designed to minimise the actions required by the user to select the common functionalities of the appliance. An improved version of the graphical user interface may also identify and store, in a special memory, the most used selections to update properly the user interface menu with the user personal preferences.

BRIEF DESCRIPTION OF THE DRAWINGS

Further advantages and features according to the present invention will become clear from the following detailed description provided by way of non-limiting example, with reference to the appended drawings in which.

DETAILED DESCRIPTION OF THE PREFERRED EMBODIMENTS

Figure 1:
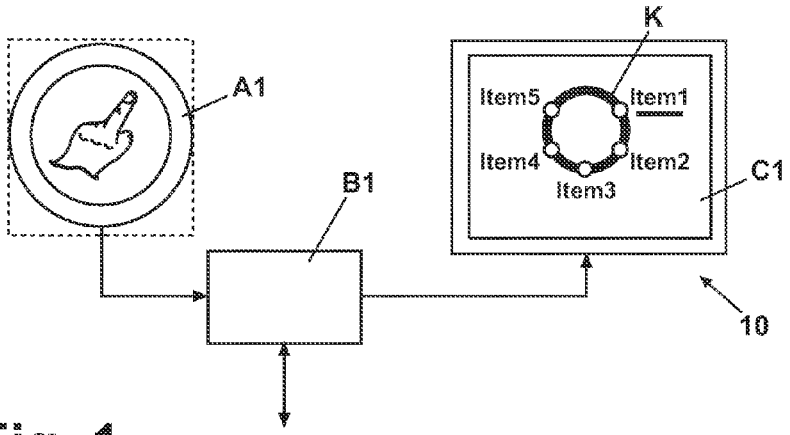
FIG. 1 is a block diagram of user interface unit according to a first embodiment of the present invention.

With reference to FIG. 1 a user interface 10 for an appliance comprises a touch input annular zone A1 where the user moves its finger to interact with the appliance. With B1 it is indicated the electronic device that reads the input sensors and "translates" it into a relative similar movement in the output display device C1, in this first embodiment following a circle path and selecting the closer item in the menu displayed. A processor is provided which is able to collect input from sensitive area A1 and to organise the menu properly in the display area C1 in order to obtain an intuitive navigation with a direct feedback of finger moving in the sensitive input zone A1. The user interface processor is connected with the appliance with an interface device, for example with a bi-directional bus.

The display C1 of the output device may be a LCD, colour LCD, OLED, VFD or any adequate similar device. In the case shown in FIG. 1 item 1 is shown as the one selected. In the case of a cooking appliance, the item can be the function of the oven (i.e. grill, fan, activated heating element etc.) or any parameters thereof (temperature, humidity, time etc.).

Figure 2:
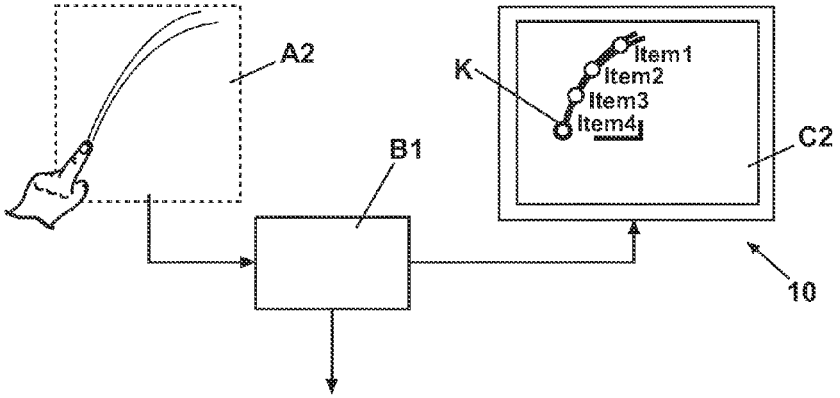
FIGS. 2-4 are block diagrams of user interfaces according to different embodiments of the present invention.

In FIG. 2 a second embodiment is shown in which a touch input zone A2 has a curved line shape, similar to the curved line path of the corresponding display zone C2. In this case item 4 is shown as the one selected.

Figure 3:
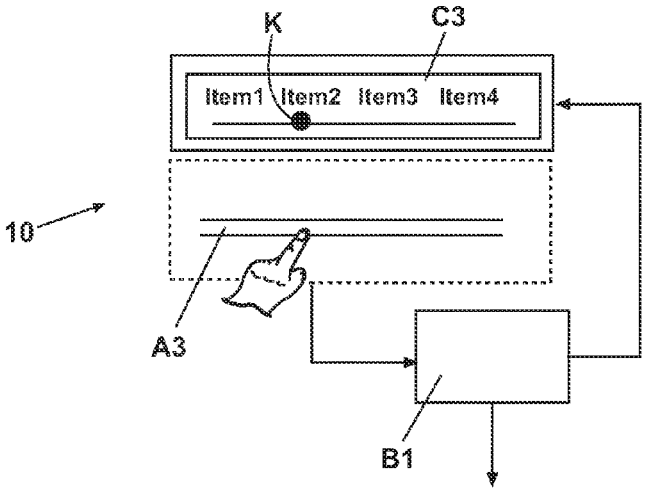
Figure 4:
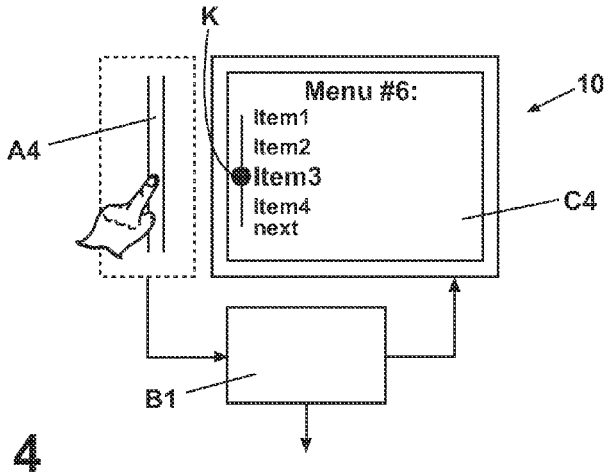

In FIG. 3 a third embodiment is shown in which a touch input zone A3 has an horizontal linear shape, corresponding to the horizontal linear shape of the display zone C3, while in FIG. 4 the touch input zone A4 and the corresponding display zone C4 have vertical linear shapes. In these shown embodiments item 2 for horizontal and item 3 for vertical version are selected. A small black circle K is used to give a direct feedback of user finger position.

Figure 5:
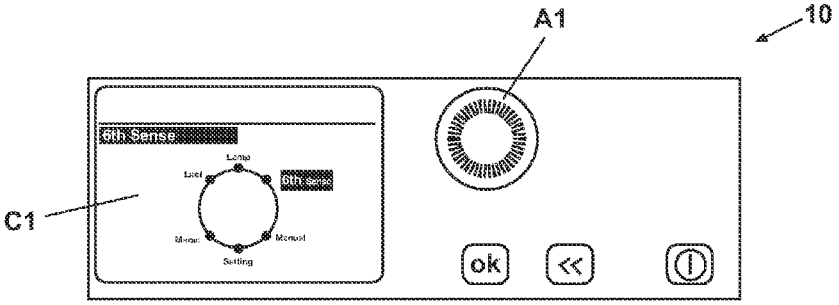
FIG. 5 is an example of how the invention is implemented on a domestic appliance.

FIG. 5 shows a real implementation of the first embodiment (circular version) of the invention. The large graphical display permits to reserve an area for the contest help and displays the parameters already selected from user.

In the pictures is also possible to identify one aim of the invention, the correspondence between the circle menu C1 and the area A1 sensitive to user's finger. A separate "OK" button confirms the selected option permitting to pass in the following menu and to select optional sub-options. Separate buttons to switch on/off the appliance and move to previous menu are included.

Figure 6:
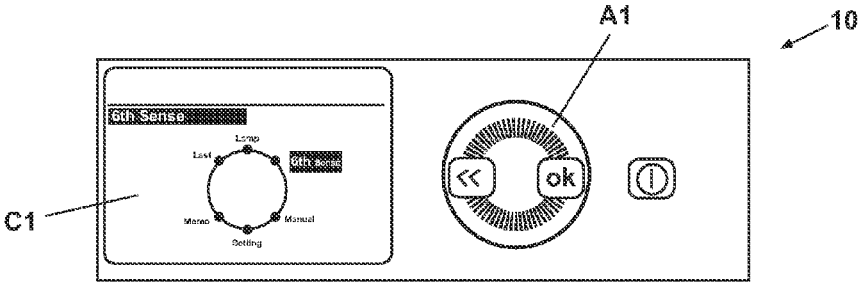
FIG. 6 is another example of implementation similar to the one of FIG. 5.

FIG. 6 shows another real implementation of the invention where some buttons are located inside the circle touch sensor A1 and a special more sophisticated software is necessary to assess when the user finger is selecting in the menu options or confirming the selected feature clicking OK zone. Perceptible vibrations may help the customer to understand that touched zone is selecting an active items in the menu.

The user interface according to the present invention is specifically useful for domestic built-in oven in which the user interface is placed on the oven door. Modem ovens have a wide door that may include also a space previously taken by the front panel of the oven. Therefore the old known interface with knobs and buttons are no longer suitable for slim glass door where a user interface must have a thickness which is comparable to the thickness of the glass door or in which the user interface is covered by a full glass door. The user interface according to the present invention is particularly suitable for the above kind of modern ovens due to its reduced thickness and absence of moving components.

Figure 7:
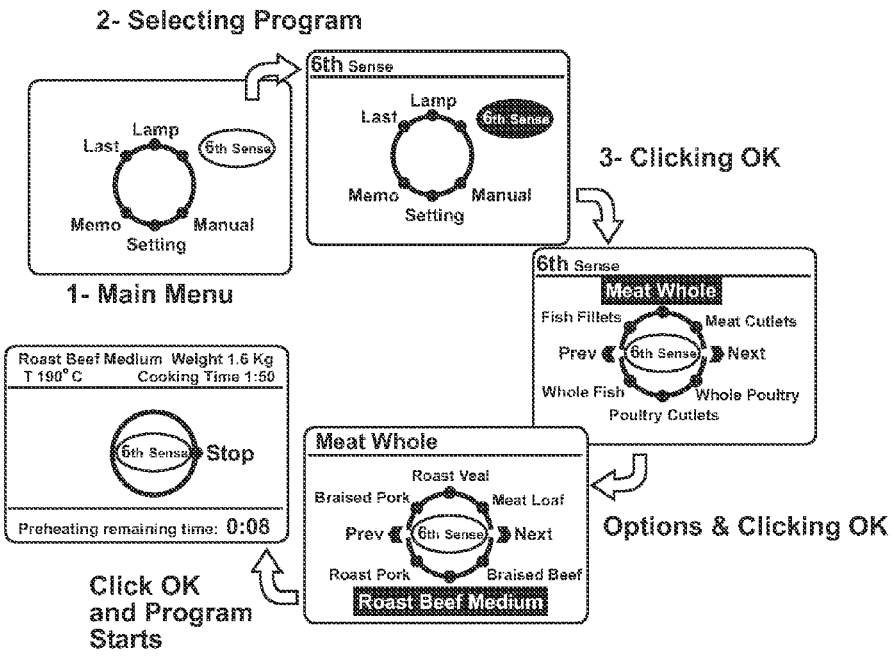
FIG. 7 is a detailed example of circle user interface navigation for a domestic oven according to the embodiment of FIG. 1 of the present invention.

FIG. 7 shows a more detailed example of user interface navigation according to the general embodiment of FIG. 1. This figure shows how the present invention permits to activate the appliance by selecting a cooking program. In this specific example, the user is activating the option "$6^{th}$ sense" and cooking roast beef in few steps, just moving the finger in the circular sensitive zone A1 (FIG. 1) and confirming the selections with the "OK" button (FIG. 5 or FIG. 6).

Figure 8:
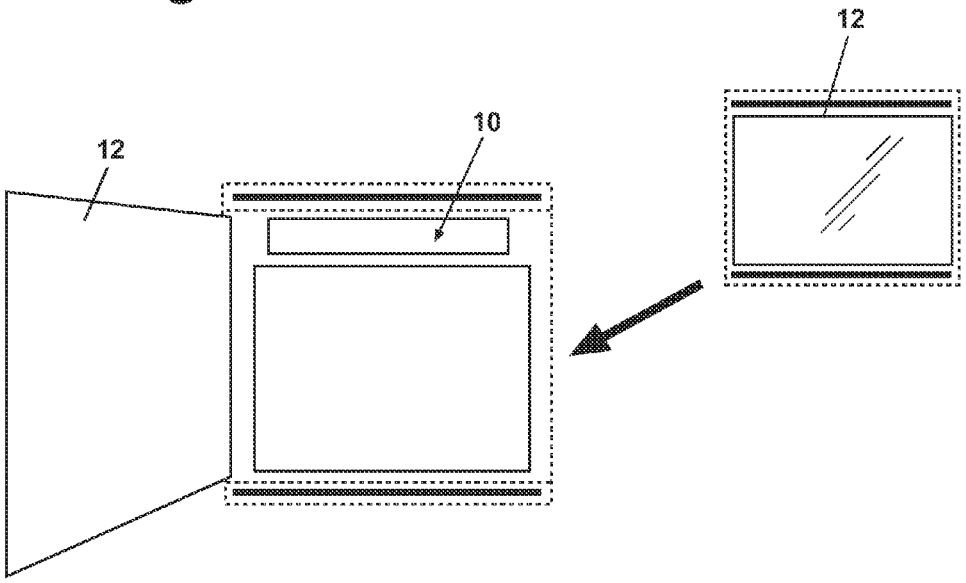
FIG. 8 is a schematic frontal view of a domestic oven having the user interface according to the present invention in two different configurations of the oven.

FIG. 8 shows how the user interface 10 according to the present invention may be used for a domestic oven either with the door open (left portion of FIG. 8) or closed (right portion of FIG. 8). In FIG. 8 with 12 it is indicated a full glass door which covers the whole user interface area comprising the touch screen area and the display device. By using the electronic control device associated to the user interface, the touch zone of the user interface 10 updates its sensitivity in order to interact properly with the user in the above two configurations (door open or door closed). Such update is triggered by a sensor or by a switch detecting the configuration of the door 12.

We claim:

1. A user interface for domestic appliances, comprising:

a selection zone configured to sense movement of a user's finger across the selection zone; a display area, distinct from the selection zone, configured to display appliance use options including menu items, wherein at least a portion of the display area includes a shape substantially corresponding to a shape of the selection zone; and a processor configured to translate the sensed movement of the user's finger across the selection zone into corresponding movement in the display area such that remote navigation of the display area is obtained through movement of the user's finger across the selection zone, receive a user selection from the appliance use options and display the user selection in the display, wherein the user interface is installed on a cooking oven including a door made of glass adapted to close a cavity of the cooking oven and wherein, when the door is in a closed position, the door covers the user interface and the appliance use options may be selected by the user through the glass of the door.

2. The user interface according to claim 1, wherein each of the selection zone and the at least a portion of the display area has a shape selected from the group consisting of a circular shape, a linear shape, and a curved shape.

3. The user interface according to claim 1, wherein the selection zone further includes one or more touch sensitive auxiliary zones adapted to be touched by the user, wherein the one or more touch sensitive auxiliary zones communicate with the processor in order to confirm the user selection from the appliance use options or scroll among different appliance use options.

4. The user interface of claim 1, wherein the user interface is installed on a door of a domestic appliance.

5. The user interface of claim 2, wherein the user interface is installed on a door of a domestic appliance.

6. The user interface of claim 3, wherein the user interface is installed on a door of a domestic appliance.

7. The user interface of claim 1, wherein the user interface comprises a control device capable of sensing a configuration of the door and adjusting a sensitivity of the selection zone of the user interface according to the configuration of the door.

8. A cooking appliance comprising:

an oven cavity;

a door made of glass adapted to close the oven cavity; and a user interface including:

a selection zone configured to sense movement of a user's finger across the selection zone;

a display area, distinct from the selection zone, configured to display appliance use options including menu items, wherein at least a portion of the display area includes a shape substantially corresponding to a shape of the selection zone; and a processor configured to translate the sensed movement of the user's finger across the selection zone into corresponding movement in the display area such that remote navigation of the display area is obtained through movement of the user's finger across the selection zone, receive a user selection from the appliance use options and display the user selection in the display wherein, when the door is in a closed position, the glass door covers the user interface and the appliance use options may be selected by the user through the glass of the door.

9. The cooking appliance of claim 8, wherein each of the selection zone and the at least a portion of the display area has a shape selected from the group consisting of a circular shape, a linear shape, and a curved shape.

10. The cooking appliance of claim 8, wherein the user interface is installed on the door.

11. The cooking appliance of claim 8, wherein the user interface comprises a control device configured to detect a configuration of the door and adjust a sensitivity of the selection zone of the user interface according to the configuration of the door.

* * * * *